US008506051B2

(12) United States Patent
Gulvin et al.

(10) Patent No.: US 8,506,051 B2
(45) **Date of Patent: *Aug. 13, 2013**

(54) PROCESS FOR PREPARING AN INK JET PRINT HEAD FRONT FACE HAVING A TEXTURED SUPEROLEOPHOBIC SURFACE

(75) Inventors: Peter Michael Gulvin, Webster, NY (US); Hong Zhao, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 635 days.

This patent is subject to a terminal disclaimer.

(21) Appl. No.: 12/648,004

(22) Filed: Dec. 28, 2009

(65) Prior Publication Data

US 2011/0157278 A1 Jun. 30, 2011

(51) Int. Cl.
*B41J 2/14* (2006.01)

(52) U.S. Cl.
USPC ..... 347/47

(58) Field of Classification Search
USPC ..... 347/47; 427/466
See application file for complete search history.

(56) References Cited

U.S. PATENT DOCUMENTS

| | | | | |
|---|---|---|---|---|
| 4,719,480 | A * | 1/1988 | Elrod et al. | 347/46 |
| 4,889,560 | A | 12/1989 | Jaeger et al. | |
| 4,889,761 | A | 12/1989 | Titterington et al. | |
| 5,121,141 | A * | 6/1992 | Hadimoglu et al. | 347/46 |
| 5,221,335 | A | 6/1993 | Williams et al. | |
| 5,230,926 | A | 7/1993 | Narang et al. | |
| 5,372,852 | A | 12/1994 | Titterington et al. | |
| 5,432,539 | A | 7/1995 | Anderson | |
| 5,621,022 | A | 4/1997 | Jaeger et al. | |
| 5,867,189 | A | 2/1999 | Whitlow et al. | |
| 6,284,377 | B1 | 9/2001 | Veerasamy | |
| 6,648,470 | B2 * | 11/2003 | Korem | 347/106 |
| 6,737,109 | B2 | 5/2004 | Stanton et al. | |
| 6,775,502 | B1 | 8/2004 | Domoto et al. | |
| 7,259,275 | B2 | 8/2007 | Belelie et al. | |
| 7,271,284 | B2 | 9/2007 | Toma et al. | |
| 7,276,614 | B2 | 10/2007 | Toma et al. | |
| 7,279,587 | B2 | 10/2007 | Odell et al. | |
| 2002/0005878 | A1 * | 1/2002 | Moon et al. | 347/58 |
| 2005/0206705 | A1 | 9/2005 | Ma et al. | |
| 2006/0078724 | A1 | 4/2006 | Bhushan et al. | |
| 2007/0120910 | A1 | 5/2007 | Odell et al. | |
| 2007/0123606 | A1 | 5/2007 | Toma et al. | |
| 2008/0225082 | A1 | 9/2008 | Mcavoy et al. | |
| 2008/0316247 | A1 | 12/2008 | Cellura et al. | |
| 2009/0046125 | A1 | 2/2009 | Nystrom et al. | |
| 2009/0141110 | A1 | 6/2009 | Gervasi et al. | |
| 2009/0142112 | A1 | 6/2009 | Gervasi et al. | |

OTHER PUBLICATIONS

U.S. Patent Application filed Dec. 28, 2009, of Varun Sambhy et al., entitled "Image Conditioning Coating" 26 pages, 4 drawing sheets, U.S. Appl. No. 12/625,472, not yet published.

(Continued)

*Primary Examiner* — Lamson Nguyen
(74) *Attorney, Agent, or Firm* — Marylou J. Lavoie

(57) ABSTRACT

A process for preparing an ink jet print head front face or nozzle plate having a textured superoleophobic surface comprising providing a silicon substrate; using photolithography to create a textured pattern in the silicon substrate; optionally, modifying the textured silicon surface by disposing a conformal oleophobic coating thereon; and forming an ink jet print head front face or nozzle plate from the textured oleophobic silicon material to provide an ink jet print head front face or nozzle plate having a textured superoleophobic surface.

15 Claims, 9 Drawing Sheets

(56) References Cited

OTHER PUBLICATIONS

U.S. Patent Application filed Aug. 19, 2009, of David J. Gervasi et al., entitled "Polyhedral Oligomeric Silsesquioxane Image Conditioning Coating" 39 pages, 4 drawing sheets, U.S. Appl. No. 12/544/031, not yet published.
U.S. Patent Application filed Dec. 9, 2008, of Steven E. Ready et al., entitled "Spreading and Leveling of Curable Gel Ink" 13 pages, 4 drawing sheets, U.S. Appl. No. 12/331/076, not yet published.
Rios et al., "The Effect of Polymer Surface on the Wetting and Adhesion of Liquid Systems," J. Adhesion Sci. Technol., vol. 21, No. 3-4, pp. 227-241 (2007).
Zisman, "Relation of the Equilibrium Contact Angle to Liquid and Solid Constitution," Advances in Chemistry Series, (1964), 43, 1-51.
Ahuja et al., "Nanonails: A Simple Geometrical Approach to Electrically Tunable Superlyophobic Surfaces," Langmuir, vol. 24, No. 1, 2008, Published on Web Oct. 12, 2007, pp. 9-14.
U.S. Patent Application filed Nov. 24, 2009, of Gregory J. Kovacs et al., entitled "Coating for an Ink Jet Printhead Front Face" 26 pages, 6 drawing sheets, U.S. Appl. No. 12/625/442, not yet published.
U.S. Patent Application filed Dec. 28, 2009, of Hong Zhao et al., entitled "Superoleophobic and Superhydrophobic Devices and Method for Preparing Same" 24 pages, 6 drawing sheets, U.S. Appl. No. 12/647,945, not yet published.
U.S. Patent Application filed Dec. 28, 2009, of Hong Zhao et al., entitled "A Process for Preparing an Ink Jet Print Head Front Face Having a Textured Superoleophobic Surface" 28 pages, 9 drawing sheets, U.S. Appl. No. 12/648,004, not yet published.
U.S. Patent Application filed Dec. 28, 2009, of Hong Zhao et al., entitled "Superoleophobic and Superhydrophobic Surfaces and Method for Preparing Same" 23 pages, 4 drawing sheets, U.S. Appl. No. 12/647,977, not yet published.
Koene et al., "Ultrahydrophobic Coatings," Smart Coatings Proceeding, Feb. 27-29, 2008, 40 pages.
Jun et al., "Direct-current substrate bias effects on amorphous silicon sputter-deposited films for thin film transistor fabrication," Applied Physics Letters, 87, 132108 (2005), 3 pages.
Kwon et al., "Low Temperature Thin Film Poly-Si Thin Film Transistor on Plastic Substrates," IEICE Trans. Electron, vol. E88-C, No. 4, Apr. 2005, 5 pages.
Bae et al., "Characteristics of Amorphous and Polysilicon Films Deposited at 120° C. by Electron Cyclotron Resonance Plasma-Enhanced Chemical Vapor Deposition," J. Vac. Sci. Technol. A 16(3), May/Jun. 1998, 5 pages.
Tenhaeff et al., "Initiated and Oxidative Chemical Vapor Deposition of Polymeric Thin Films: iCVD and oCVD," Adv. Func. Mater. 2008, 18, pp. 979-992.
Neinhuis et al., "Characterization and Distribution of Water-Repellant, Self-Cleaning Plant Surfaces," Annals of Botany 79: 1997, pp. 667-677.
Artus et al., "Silicone Nanofilaments and Their Application As Superhydrophobic Coatings," Adv. Mater. 2006, 18, pp. 2758-2762.
Choi et al., "Fabrics With Tunable Oleophobicity," Adv. Mater. 2009, 21, pp. 2190-2195.
Feng et al., "Super-Hydrophobic Surfaces: From Natural to Artificial," Adv. Mater. 2002, !4, pp. 1857-1860.
Robert N. Wenzel, "Resistance of Solid Surfaces to Wetting by Water," Industrial and Engineering Chemistry, vol. 28, No. 8, Aug. 1936, pp. 988-994.
Tillman et el., "Incorporation of Phenoxy Groups in Self-Assembled Monolayers of Trichlorosilane Derivatives: Effects on Film Thickness, Wettability, and Molecular Orientation," J. Am. Chem. Soc. 1988, 110, pp. 6136-6144.
Zhang et al., "Superhydrophobic Surfaces: from structural control to functional application," J. Mater. Chem., 2008, 18, pp. 621-633.
Parikh et al., "An Intrinsic Relationship Between Molecular Structure in Self-Assembled n-Alkylsiloxane Monolayers and Deposition Temperature," J. Phys. Chem. 1994, 98, pp. 7577-7590.
Robert N. Wenzel, "Communication to the Editor, Surface Roughness and Contact Angle," J. Phys. Colloid Chem., Oct. 25, 1949, pp. 1466-1467.
M. Morra et al., Contact Angle Hysteresis in Oxygen Plasma Treated Poly(tretrafluoroethylene), Langmuir, vol. 5, No. 3, 1989, pp. 872-876.
Öner et al., "Ultrahydrophobic Surfaces. Effect of Topography Length Scales on Wettability," Langmuir, vol. 16, No. 20, 2000, pp. 7777-7782.
Fürstner et al., "Wetting and Self-Cleaning Properties of Artificial Superhydrophobic Surfaces," Langmuir, vol. 21, No. 3, 2005, pp. 956-961.
Abraham Marmur, "Wetting on Hydrophobic Rough Surfaces: to Be Heterogeneous or Not to Be," Langmuir, vol. 19, No. 20, 2003, pp. 8343-8348.
Sun et al., "Artificial Lotus Leaf by Nanocasting," Langmuir, vol. 19, No. 19, 2005, pp. 8978-8981.
Puukilainen et al., "Superhydrophobic Polyolefin Surfaces: Controlled Micro- and Nanostructures," Langmuir, vol. 23, No. 13, 2007, pp. 7263-7268.
Lai et al., "Markedly Controllable Adhesion of Superhydrophobic Spongelike Nanostructure $TiO_2$ Films," Langmuir, vol. 24, No. 8, 2008, pp. 3867-3873.
Reyssat et al., "Contact Angle Hysteresis Generated by Strong Dilute Defects," J. Phys. Chem., vol. 113, No. 12, 2009, pp. 3906-3909.
Tuteja et al., "Robust omniphobic surfaces," PNAS, vol. 105, No. 47, Nov. 25, 2008, pp. 18200-18205.
Tuteja et al., "Design Parameters for Superhydrophobicity and Superoleophobicity," MRS Bulletin, vol. 33, Aug. 2008, pp. 752-758.
Tuteja et al., "Designing Superoleophobic Surfaces," Science, vol. 318, Dec. 7, 2007, pp. 1618-1622.
Lau et al., "Superhydrophobic Carbon Nanotube Forests," Nano Letters, vol. 3, No. 12, 2003, pp. 1701-1705.
Zhai et al, "Stable Superhydrophobic Coatings From Polyelectrolyte Multilayers," Nano Letters, vol. 4, No. 7, 2004, pp. 1349-1353.
Martines et al, "Superhydrophobicity and Superhydrophilicity of Regular Nanopatterns," Nano Letters, vol. 5, No. 10, 2005, pp. 2097-2103.
Cheng et al., "Effects of micro- and nano-structures on the self-cleaning behavior of lotus leaves," Nanotechnology, 17, 2006, pp. 1359-1362.
Wang et al., "Microscale and nanoscale hierarchical structured mesh films with superhydrophobic and superoleophilic properties induced by long-chain fatty acids," Nanotechnology, 18, 2007, 5 pages.
Kobrin et al., "Durable Anti-Stiction Coatings by Molecular Vapor Deposition (MVD)," NSTI-Nanotech 2005, vol. 2, pp. 347-350.
Barthlott et al., "Purity of the sacred lotus, or escape from contamination in biological surfaces," Planta, 1997, pp. 1-8.
Erbil et al., "Transformation of a Simple Plastic Into a Superhydrophobic Surface," Science, vol. 299, Feb. 28, 2003, pp. 1377-1380.
Roach et al., "Progress in superhydrophobic surface development," Soft Matter, 2008, 4, pp. 224-240.
Martin et al., "Initiated Chemical Vapor Depostion (iCVD) of Polymeric Nanocoatings," Surface and Coatings Technology 201, 2007, pp. 9400-9405.
Cassie and Baxter, "Wettability of Porous Surfaces," Trans. Faraday Society, Jun. 19, 1944, 6 pages.
Boreyko et al., "Abstract: EG.00004: Vibration-induced Wenzel to Cassie Transition on a Superhydrophobic Surface," http://meetings.aps.org/link/BAPS.2008.DFD.EG.4, 1 page.

* cited by examiner

PROCESS FOR PREPARING AN INK JET PRINT HEAD FRONT FACE HAVING A TEXTURED SUPEROLEOPHOBIC SURFACE

TECHNICAL FIELD

Described herein is a process for preparing an ink jet print head front face or nozzle plate having a textured superoleophobic surface comprising providing a silicon substrate; using photolithography to create a textured pattern in the silicon; and optionally modifying the textured surface by disposing a conformal, oleophobic coating thereon; to provide a textured, oleophobic surface; and forming a textured superoleophobic ink jet print head front face or nozzle plate from the silicon having the textured, oleophobic surface.

RELATED APPLICATIONS

Commonly assigned U.S. patent application Ser. No. 12/647,977, entitled "Superoleophobic and Superhydrophobic Surfaces and Method For Preparing Same," filed concurrently herewith, which is hereby incorporated by reference herein in its entirety, describes a process for preparing a flexible device having a superoleophobic surface comprising providing a flexible substrate; disposing a silicon layer on the flexible substrate; using photolithography to create a textured pattern in the silicon layer on the substrate wherein the textured pattern comprises a groove structure; and chemically modifying the textured surface by disposing a conformal oleophobic coating thereon; to provide a flexible device having a superoleophobic surface.

Commonly assigned U.S. patent application Ser. No. 12/647,945, entitled "Superoleophobic and Superhydrophobic Devices And Method For Preparing Same," filed concurrently herewith, which is hereby incorporated by reference herein in its entirety, describes a process for preparing a flexible device having a textured superoleophobic surface comprising providing a flexible substrate; disposing a silicon layer on the flexible substrate; using photolithography to create a textured pattern on the substrate wherein the textured pattern comprises an array of pillars; and chemically modifying the textured surface by disposing a conformal oleophobic coating thereon; to provide a flexible device having a superoleophobic surface and, in embodiments, to provide a flexible device having a surface that is both superoleophobic and superhydrophobic.

BACKGROUND

Disclosed herein is a process for preparing an ink jet printhead front face or nozzle plate having a textured superoleophobic surface, the process comprising providing a silicon substrate; using photolithography to create a textured pattern in the silicon, wherein the textured pattern comprises an array of pillars, a grooved pattern, other textured pattern, or combination thereof, which renders the surface superoleophobic; and optionally modifying the textured surface, such as by disposing a fluorosilane coating thereon; to provide an ink jet printhead front face or nozzle plate having a textured superoleophobic surface. In specific embodiments, the flexible, superoleophobic device can be used as a front face or nozzle plate surface for a microelectromechanical system (MEMS-Jet) based drop ejector print head.

Fluid ink jet systems typically include one or more printheads having a plurality of ink jets from which drops of fluid are ejected towards a recording medium. The ink jets of a printhead receive ink from an ink supply chamber or manifold in the printhead which, in turn, receives ink from a source, such as a melted ink reservoir or an ink cartridge. Each ink jet includes a channel having one end in fluid communication with the ink supply manifold. The other end of the ink channel has an orifice or nozzle for ejecting drops of ink. The nozzles of the ink jets may be formed in an aperture or nozzle plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to one another, the deposited drops can be precisely patterned to form particular text and graphic images on the recording medium. MEMSJet drop ejectors consist of an air chamber under an ink chamber, with a flexible membrane in-between. Voltage is applied to an electrode inside the air chamber, attracting the grounded flexible membrane downward, increasing the volume of the ink chamber and thus lowering its pressure. This causes ink to flow into the ink chamber from the ink reservoir. The electrode is then grounded and the membrane's restoring force propels it upward, creating a pressure spike in the ink cavity that ejects a drop from the nozzle. An example of a full width array printhead is described in U.S. Patent Publication 20090046125, which is hereby incorporated by reference herein in its entirety. An example of an ultra-violet curable gel ink which can be jetted in such a printhead is described in U.S. Patent Publication 20070123606, which is hereby incorporated by reference herein in its entirety. An example of a solid ink which can be jetted in such a printhead is the Xerox Color Qube™ cyan solid ink available from Xerox Corporation. U.S. Pat. No. 5,867,189, which is hereby incorporated by reference herein in its entirety, describes an ink jet print head including an ink ejecting component which incorporates an electropolished ink-contacting or orifice surface on the outlet side of the printhead.

One difficulty faced by fluid ink jet systems is wetting, drooling or flooding of inks onto the printhead front face. Such contamination of the printhead front face can cause or contribute to blocking of the ink jet nozzles and channels, which alone or in combination with the wetted, contaminated front face, can cause or contribute to non-firing or missing drops, undersized or otherwise wrong-sized drops, satellites, or misdirected drops on the recording medium and thus result in degraded print quality. Current printhead front face coatings are typically coated with a hydrophobic coating, for example, a sputtered polytetrafluoroethylene coating. However, the ink as an organic matter behaves differently than water, and can demonstrate ink-philic characteristics with the front face surface. When the printhead is tilted, the UV gel ink at a temperature of about 75° C. (75° C. being a typical jetting temperature for UV gel ink) and the solid ink at a temperature of about 105° C. (105° C. being a typical jetting temperature for solid ink) do not readily slide on the printhead front face surface. Rather, these inks flow along the printhead front face and leave an ink film or residue on the printhead which can interfere with jetting. For this reason, the front faces of UV and solid ink printheads are prone to be contaminated by UV and solid inks. In some cases, the contaminated printhead can be refreshed or cleaned with a maintenance unit. However, such an approach introduces system complexity, hardware cost, and sometimes reliability issues. Further, the front face coatings sometimes have trouble withstanding the chemistry of the ink, and repeated wiping from a maintenance wiper blade often clears away much of the coating, resulting in more severe ink wetting and flowing on the nozzle plate surface, leaving residues. Additionally, full-width array printheads made up of a series of subunits must be potted to fill in the cracks between units, in order to avoid damage to the wiper blade from the edges of the subunits. This can make reworking of the print heads very difficult because the potting must be removed and reapplied after the new subunit is inserted.

There remains a need for an ink jet print head and method for preparing same wherein the front face or nozzle plate exhibits superoleophobic characteristics alone or in combination with superhydrophobic characteristics. Further, while currently available coatings for ink jet printhead front faces are suitable for their intended purposes, a need remains for an improved printhead front face design that reduces or eliminates wetting, drooling, flooding, or contamination of UV or solid ink over the printhead front face. There further remains a need for an improved printhead front face design that is ink phobic, that is, oleophobic, and robust to withstand maintenance procedures such as wiping of the printhead front face. There further remains a need for an improved printhead front face design that is superoleophobic and, in embodiments, that is both superoleophobic and superhydrophobic. There further remains a need for an improved printhead that is easily cleaned or that is self-cleaning, thereby eliminating hardware complexity, such as the need for a maintenance unit, reducing run cost and improving system reliability.

The appropriate components and process aspects of the each of the foregoing U.S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a process for preparing an ink jet print head front face or nozzle plate having a textured superoleophobic surface comprising providing a silicon substrate; using photolithography to create a textured pattern in the silicon substrate; optionally, modifying the textured silicon surface, to provide a textured oleophobic silicon material; and forming an ink jet print head front face or nozzle plate from the textured oleophobic silicon material to provide an ink jet print head front face or nozzle plate having a textured superoleophobic surface. In embodiments, modifying the textured silicon surface comprises disposing a conformal oleophobic coating thereon. In various embodiments, the textured pattern comprises an array of pillars, a groove pattern, an array of pillars or groove pattern including wavy sidewalls, re-entrant overhang structures, or a combination thereof. In further embodiments, the textured surface comprises a configuration suitable for directing a flow of liquid in a selected flow pattern.

Also described is an ink jet print head front face or nozzle plate having a textured superoleophobic surface comprising a silicon substrate, wherein the silicon comprises a textured pattern; and optionally a conformal oleophobic coating disposed on the textured silicon surface.

Further described is an ink jet printer having a print head comprising a front face comprising a silicon substrate, wherein the silicon comprises a textured pattern; and optionally a conformal oleophobic coating disposed on the textured silicon surface.

DETAILED DESCRIPTION

Described is a process for preparing an ink jet print head front face or nozzle plate having a textured highly oleophobic or superoleophobic surface, comprising providing a silicon substrate; using photolithography to create a textured pattern in the silicon substrate, wherein in embodiments, the textured pattern comprises an array of pillars; optionally modifying the textured surface by disposing a conformal, oleophobic coating thereon; to provide a textured oleophobic silicon; and forming an ink jet print head front face or nozzle plate from the textured oleophobic silicon. In embodiments, the textured surface is a highly oleophobic surface or a superoleophobic surface, and, in embodiments, a surface that is both superoleophobic and superhydrophobic.

Contact Angle-Oleophobicity.

Highly oleophobic as used herein can be described as when a droplet of hydrocarbon-based liquid, for example, ink, forms a high contact angle with a surface, such as a contact angle of from about 130° to about 175° or from about 135° to about 170°. Superoleophobic as used herein can be described as when a droplet of hydrocarbon-based liquid, for example, ink, forms a high contact-angle with a surface, such as a contact angle that is greater than 150°, or from greater than about 150° to about 175°, or from greater than about 150° to about 160°.

Sliding Angle-Oleophobicity.

Superoleophobic as used herein can also be described as when a droplet of a hydrocarbon-based liquid, for example, hexadecane, forms a sliding angle with a surface of from about 1° to less than about 30°, or from about 1° to less than about 25°, or a sliding angle of less than about 25°, or a sliding angle of less than about 15°, or a sliding angle of less than about 10°.

Contact Angle-Hydrophobicity.

Highly hydrophobic as used herein can be described as when a droplet of water forms a high contact angle with a surface, such as a contact angle of from about 130° to about 180°. Superhydrophobic as used herein can be described as when a droplet of water forms a high contact angle with a surface, such as a contact angle of greater than about 150°, or from greater about 150° to about 180°.

Sliding Angle-Hydrophobicity.

Superhydrophobic as used herein can be described as when a droplet of water forms a sliding angle with a surface, such as a sliding angle of from about 1° to less than about 30°, or from about 1° to about 25°, or a sliding angle of less than about 15°, or a sliding angle of less than about 10°.

Figure 1:
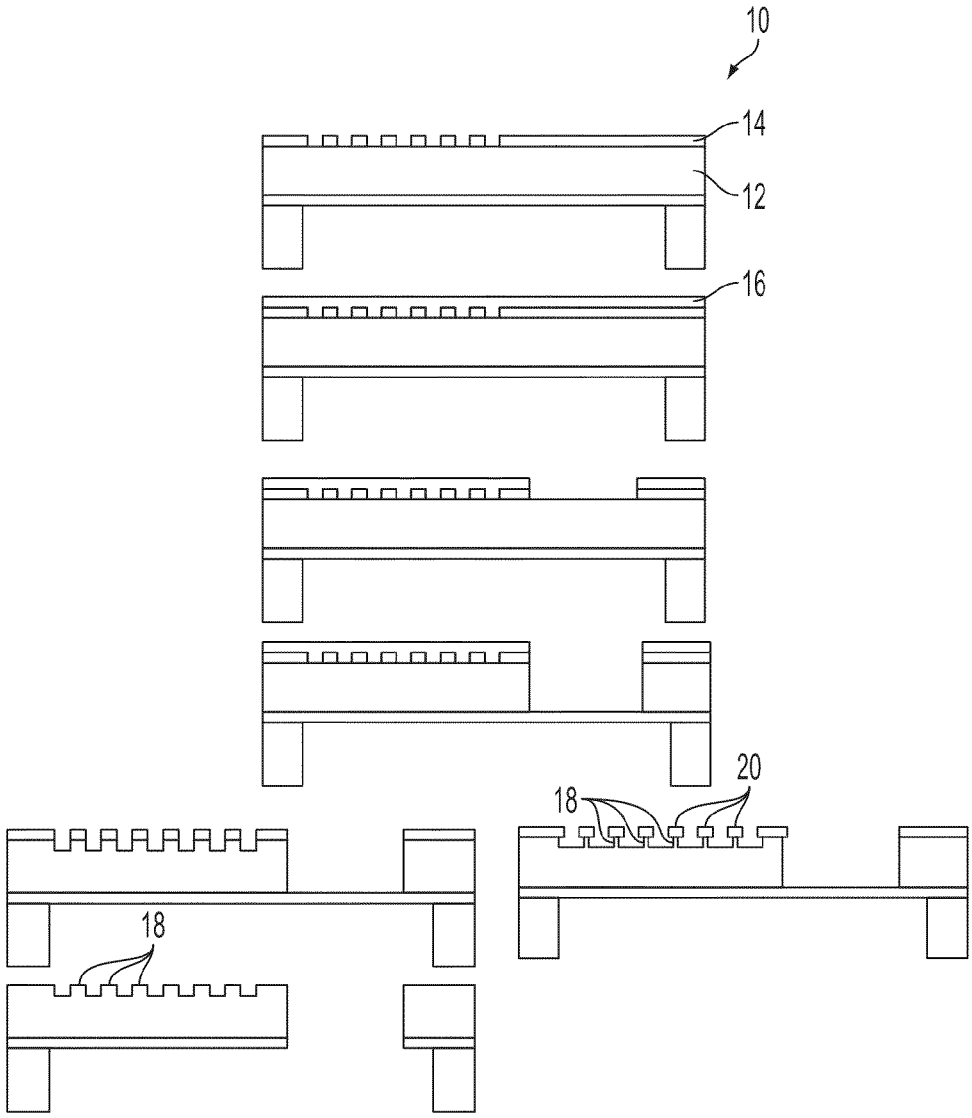
FIG. 1 is a flow diagram illustrating a process scheme for creating nozzle apertures and preparing a textured surface having wavy sidewalls (left branch) and for preparing a textured surface having overhang re-entrant structures (right branch).

The silicon materials having superoleophobic surfaces for forming ink jet print head front faces or nozzle plates herein can be prepared by any suitable method. Turning to FIG. 1, a process flow diagram illustrates alternate embodiments of the present process 10 wherein the left branch depicts a process for preparing a textured silicon surface comprising an array of pillars having wavy sidewalls and the right branch depicts a process for preparing a textured silicon surface comprising an array of pillars having overhang re-entrant structures on the top most portion of the pillars. A silicon substrate 12, which in selected embodiments is silicon, has disposed thereon a material 14 that can be selectively etched without attacking the silicon substrate 12. In embodiments, a second material 16 that can be selectively etched without attacking the silicon substrate 12 or the first material 14 can be depositing and etched to create the nozzle apertures in the silicon substrate using known photolithographic methods. The desired pattern can be etched using known photolithographic methods to prepare a textured silicon substrate having an array of pillars or grooves 18 (left branch) or to prepare the textured silicon surface having an array of pillars or grooves 18 with overhang re-entrant structures 20 (right branch).

Figure 2:
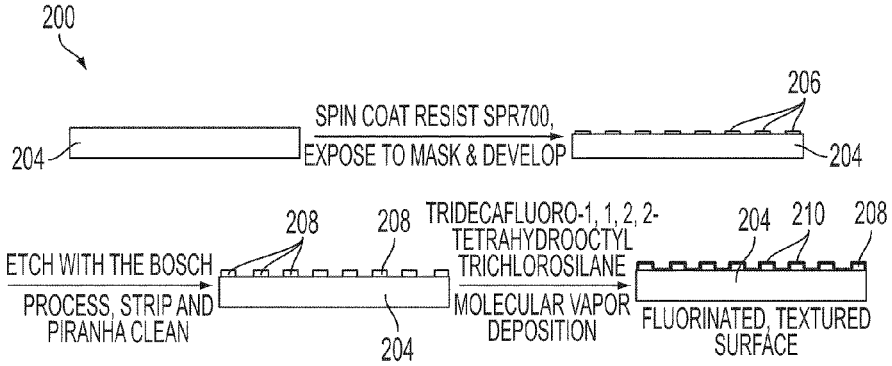
FIG. 2 is a flow diagram illustrating a process scheme for preparing a fluorinated, textured surface on a silicon substrate wherein the textured surface comprises an array of pillars having wavy sidewalls in accordance with the present disclosure.

Turning to FIG. 2, a process flow diagram illustrating another embodiment of the present process 200 whereby an ink jet print head front face or nozzle plate having superoleophobic surfaces can be prepared by using a silicon substrate 204.

Textured patterns comprising an array of pillars can be provided on the silicon substrate. The array of pillar can be defined as an array of pillars having textured or wavy vertical sidewalls, having an overhang re-entrant structure defined on the top of the pillars, or a combination thereof. Textured or wavy sidewalls as used herein can mean roughness on the sidewall which is manifested in the submicron range. In embodiments, the wavy sidewalls can have a 250 nanometer wavy structure with each wave corresponding to an etching cycle as described herein below.

Textured patterns comprising an array of pillars can be created on the silicon using photolithography techniques. For example, the silicon substrate 204 can be prepared and cleaned in accordance with known photolithographic methods. A photo resist 206 can then be applied, such as by spin coating or slot die coating the photo resist material 206 onto the silicon 204. Any suitable photo resist can be selected. In embodiments, the photo resist can be Mega™Posit™ SPR™ 700 photo resist available from Rohm and Haas.

The photo resist 206 can then be exposed and developed according to methods as known in the art, typically by exposure to ultraviolet light and exposure to an organic developer such as a sodium hydroxide containing developer or a metal-ion free developer such as tetramethylammonium hydroxide.

A textured pattern comprising an array of pillars 208 can be etched by any suitable method as known in the art. Generally, etching can comprise using a liquid or plasma chemical agent to remove layers of the silicon that are not protected by the mask 206. In embodiments, deep reactive ion etching techniques can be employed to produce the pillar arrays 208 in the silicon substrate 204.

After the etching process, the photo resist can be removed by any suitable method. For example, the photo resist can be removed by using a liquid resist stripper or a plasma-containing oxygen. In embodiments, the photo resist can be stripped using an $O_2$ plasma treatment such as the GaSonics Aura 1000 ashing system available from Surplus Process Equipment Corporation, Santa Clara, Calif. Following stripping, the substrate can be cleaned, such as with a hot piranha cleaning process.

After the surface texture is created on the silicon substrate, the surface texture can be modified, such as chemically modified. Chemically modifying the silicon substrate as used herein can comprise any suitable chemical treatment of the substrate, such as to provide or enhance the oleophobic quality of the textured surface. For example, a conformal fluorosilane coating 210 can be disposed on the pillar surface 208. In embodiments, chemically modifying the textured substrate surface comprises disposing a self assembled layer consisting of perfluorinated alkyl chains onto the textured silicon surface. A variety of technology, such as the molecular vapor deposition technique, the chemical vapor deposition technique, or the solution coating technique can be used to deposit the self assembled layer of perfluorinated alkyl chains onto the textured silicon surface. In embodiments, chemically modifying the textured silicon substrate comprises chemical modification by self-assembling a fluorosilane coating onto the textured silicon surface conformally via a molecular vapor deposition technique, a chemical vapor deposition technique, or a solution self assembly technique. In a specific embodiment, chemically modifying the textured silicon substrate comprises disposing layers assembled by tridecafluoro-1,1,2,2-tetrahydrooctyltrichlorosilane (informally known as fluoro-octyl-trichloro-silane or (FOTS), tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, heptadecafluoro-1,1,2,2-tetrahydrooctyltriethoxysilane, or a combination thereof, and the like, using the molecular vapor deposition technique or the solution coating technique. Alternately, the textured silicon substrate can be modified by disposing a coating or material thereon, such as a polytetrafluoroethylene.

In a specific embodiment, the Bosch deep reactive ion etching process comprising pulsed or time-multiplexed etching is employed to create the textured silicon surface. The Bosch process can comprise using multiple etching cycles with three separate steps within one cycle to create a vertical etch comprising: 1) deposition of a protective passivation layer, 2) Etch 1, an etching cycle to remove the passivation layer where desired, such as at the bottom of the valley, and 3) Etch 2, an etching cycle to etch the silicon isotropically. Each step lasts for several seconds. The passivation layer is created by $C_4F_8$ which is similar to Teflon® and protects the entire substrate from further chemical attack and prevents further etching. However, during the Etch 1 phase, the directional ions that bombard the substrate attack the passivation layer at the bottom of the valley (but not appreciably along the pillar sidewalls). The ions collide with the passivation layer and sputter it off, exposing the bottom of the valley on the substrate to the chemical etchant during Etch 2. Etch 2 serves to etch the silicon isotropically for a short time (for example, from about 5 to about 10 seconds). A shorter Etch 2 step gives a smaller wave period (5 seconds leads to about 250 nanometers) and a longer Etch 2 yields longer wave period (10 seconds leads to about 880 nanometers). This etching cycle can be repeated until a desirable pillar height is obtained. In this process, pillars can be created having a textured or wavy sidewall wherein each wave corresponds to one etching cycle.

The size of the periodic "wave" structure can be any suitable size. In specific embodiments herein, the size of each "wave" of the wavy sidewall is from about 100 nanometers to about 1,000 nanometers, or about 250 nanometers.

Figure 3:
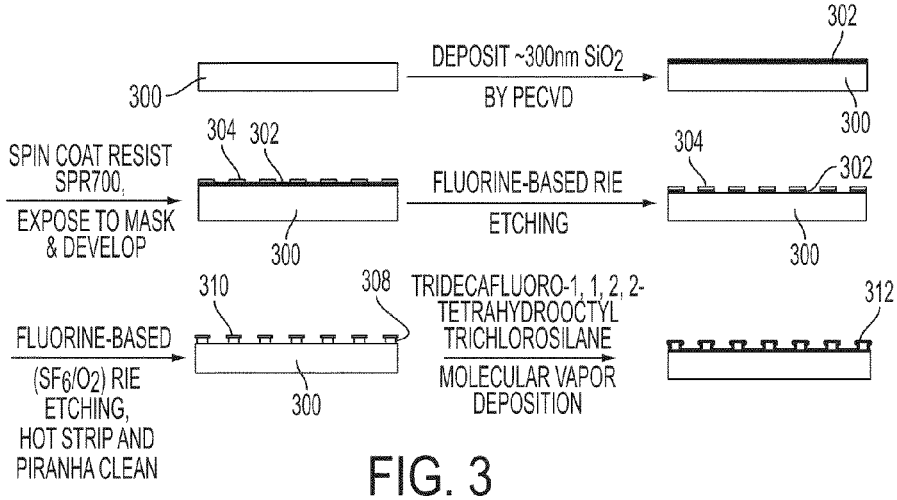
FIG. 3 is a flow diagram illustrating a process scheme for preparing a fluorinated, textured surface on a silicon substrate wherein the textured surface comprises an array of pillars having overhang structures in accordance with the present disclosure.

An embodiment of the present process comprises creating a textured surface on a silicon substrate comprising an array of pillars having overhang re-entrant structures. The process can comprise an analogous process using a combination of two fluorine etchings processes ($CH_3F/O_2$ and $SF_6/O_2$). Referring to FIG. 3, the process can comprise providing a silicon substrate 300. Silicon substrate 300 can have disposed thereon a thin silicon oxide layer 302, such as via plasma enhanced chemical vapor deposition or low pressure chemical vapor deposition. A photo resist material 304 is applied to the cleaned silicon oxide 302 layer. The process further comprises exposing and developing the photo resist material 304, such as with 5:1 photolithography using SPR™ 700-1.2 photo resist, using fluorine based reactive ion etching ($CH_3F/O_2$) to define a textured pattern in the silicon oxide layer 302 using a second fluorine based ($SF_6/O_2$) reactive ion etching process, followed by hot stripping, and piranha cleaning to create the textured pillars 308 having overhang re-entrant structures 310. Optionally a Xenon difluoride isotropic etching process can be applied to enhance the degree of overhang on textured pillars 308 (not shown in FIG. 3). $XeF_2$ vapor phase etching exhibits nearly infinite selectivity of silicon to silicon dioxide which is the cap material. In embodiments, the patterned array can then be coated with a conformal oleophobic coating 312 to provide a superoleophobic silicon comprising a textured pattern of pillars having overhanging re-entrant structures 310.

The process further comprises forming an ink jet print head front face or nozzle plate from the textured oleophobic silicon to provide a silicon ink jet print head front face or nozzle plate having a textured superoleophobic surface.

Two states are commonly used to describe the composite liquid-solid interface between liquid droplets on rough surfaces: the Cassie-Baxter state and the Wenzel state. The static contact angles for a droplet at the Cassie-Baxter state ($\theta_{CB}$) and the Wenzel state ($\theta_w$) are given by equations (1) and (2), respectively.

$$\cos\theta_{CB}=R_f f\cos\theta_\gamma+f-1 \quad (1)$$

$$\cos\theta_W=r\cos\theta_\gamma \quad (2)$$

where f is the area fraction of projected wet area, $R_f$ is the roughness ratio on the wet area and $R_f f$ is solid area fraction, r is the roughness ratio, and $\theta_\gamma$ is the contact angle of the liquid droplet with a flat surface.

In the Cassie-Baxter state, the liquid droplet "sits" primarily on air with a very large contact angle ($\theta_{CB}$). According to the equation, liquid droplets will be in the Cassie-Baxter state if the liquid and the surface have a high degree of phobicity, for example, when $\theta_\gamma \geqq 90°$).

In embodiments herein, two general geometries are provided for the textured surfaces, each of which demonstrates one of the two types of geometry-based (as opposed to a surface-coating-based) ink-phobic surfaces with overhang re-entrant structure. The re-entrant structure maintains the ink in the Cassie state which means the ink sitting on a composite surface consisting of air and a solid (non wetting state: liquid does not fill the valleys/grooves on the rough surface, characterized by high contact angle, low contact angle hysteresis and low sliding angle) with significantly decreased contact area. The re-entrant structure provides a surface roughness that prevents the initially ink-philic surface from leading to the ink entering the Wenzel state (wetting state: liquid fills up the grooves on the rough surface and the drop is pinned, characterized by high contact angle, high contact angle hysteresis and high sliding angle or pinned). Although contact angles for both states are significantly increased for both the Wenzel and Cassie states, the Cassie state is desirable due to its low sliding angle and low adhesion between the ink and textured surface.

The Cassie-Baxter equation for a solid area fraction ("f") value of 0.2 means that the probing liquids only touch 20% of the solid surface area. The exact nature of the roughness (sinusoidal, square wave, etc.) is not critical, since it's the wetted solid area that matters, but the re-entrant structure maintains the ink in Cassie state. So for example, if a surface coating were used to achieve a contact angle of 108° (water), assuming solid area fraction is 20%, the present textured coating (roughness) increases that contact angle to about 150°. Further, when the contact angle of the same surface coating for hexadecane or ink is 73°, assuming solid area fraction of 20%, the present textured coating (roughness) increases the contact angle to about 138°.

Figure 4:
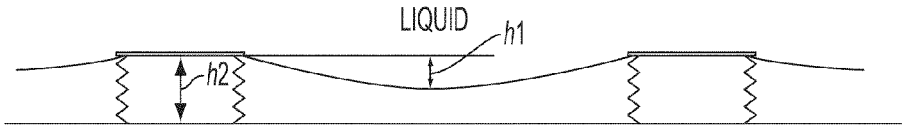
FIG. 4 is an illustration of a re-entrant pedestal structure showing the behavior of liquid/air interface.

FIG. 4 illustrates the behavior of liquid/air interface with liquid with wavy sidewall structure (forming a re-entrant overhang structure on the top waves). The textured, rough surface comprises pillars (or posts or ridges or grooves) with re-entrant overhang structures having wavy sidewall posts created with a simple DRIE etching process. The first couple of waves serve as the energy barrier to prevent the liquid from wetting the pillars. The re-entrant overhang structure formed from the first couple of waves serves as caps that interact with the liquid as shown in FIG. 4, and this corresponds to the Cassie state/model. In the Cassie state the liquid drop ends up remaining on top of the overhang structure (or cap), because in order for the liquid/air interface to travel down underneath the overhang structure, the surface would have to deform greatly, which would require forces much higher than the capillary force.

In embodiments herein, the silicon nozzle plates having textured surfaces herein are superhydrophobic having very high water contact angles of greater than about 150° and low sliding angles of less than or equal to about 10°.

With respect to hydrocarbon-based liquid, for example, ink, as exemplified by hexadecane, in embodiments, the textured silicon surfaces comprising an array of pillars having overhang re-entrant structures formed on the top surface of the pillars renders the surface "phobic" enough (that is, $\theta_\gamma=73°$ to result in the hexadecane droplet forming the Cassie-Baxter state at the liquid-solid interface of the textured, oleophobic surface. In embodiments herein, the combination of surface texture and chemical modification, for example, FOTS coating disposed on the textured silicon, results in the textured silicon surface becoming superoleophobic. On a flat surface, the oleophobic coating means the coating has a water contact angle of greater than about 100° and a hexadecane contact angle of greater than about 50°. In embodiments herein, oleophobic meaning $\theta_\gamma$=73°.

Figure 5:
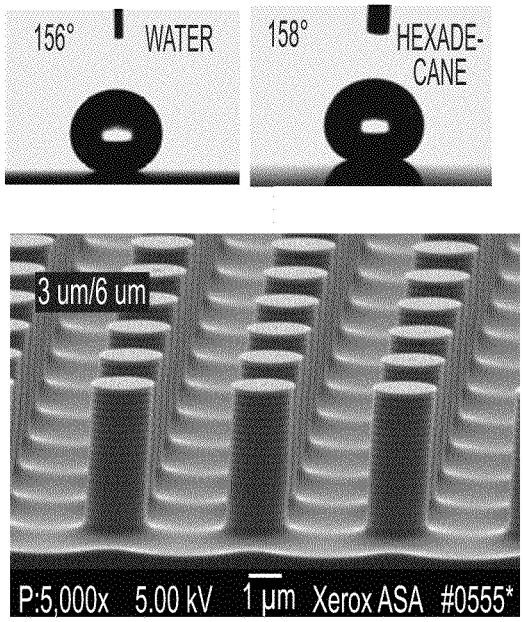
FIG. 5 is a micrograph of a fluorosilane-coated textured surface comprising an array of pillar structures having wavy sidewall posts and showing static contact angles for water and hexadecane with the surface.
Figure 6:
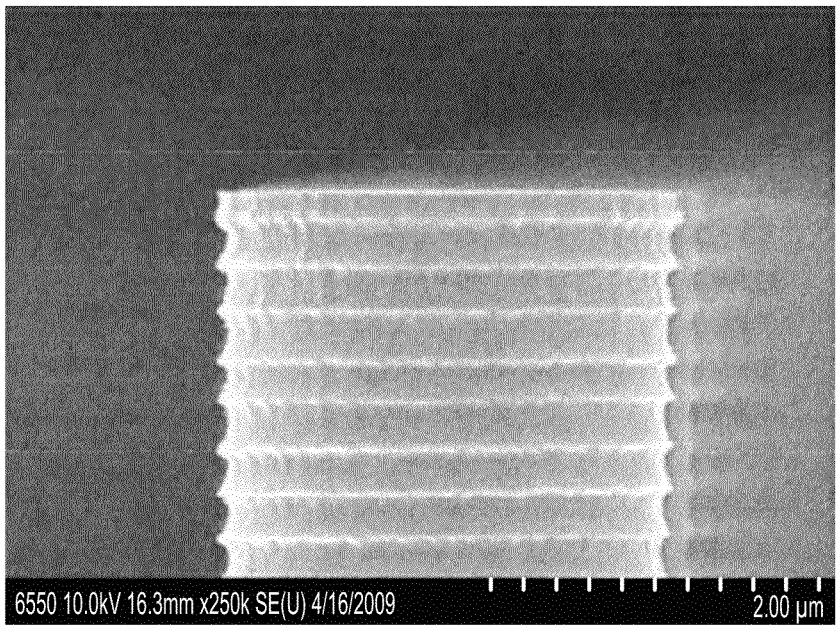
FIG. 6 is an enlarged view of a portion of the wavy sidewall post of FIG. 5.

FIG. 5 provides a micrograph of a fluorosilane-coated textured silicon surface comprising an array of pillar structures having textured (wavy) sidewalls and a pair of photographs showing static contact angles for water and hexadecane on the fluorosilane-coated textured silicon surfaces. The contact angles for the wavy sidewall FOTS coated surface with water and hexadecane are 156° and 158°, respectively. FIG. 6 provides an enlarged view of a portion of the surface of FIG. 5, showing details of the wavy sidewall pillar structure.

Figure 7:
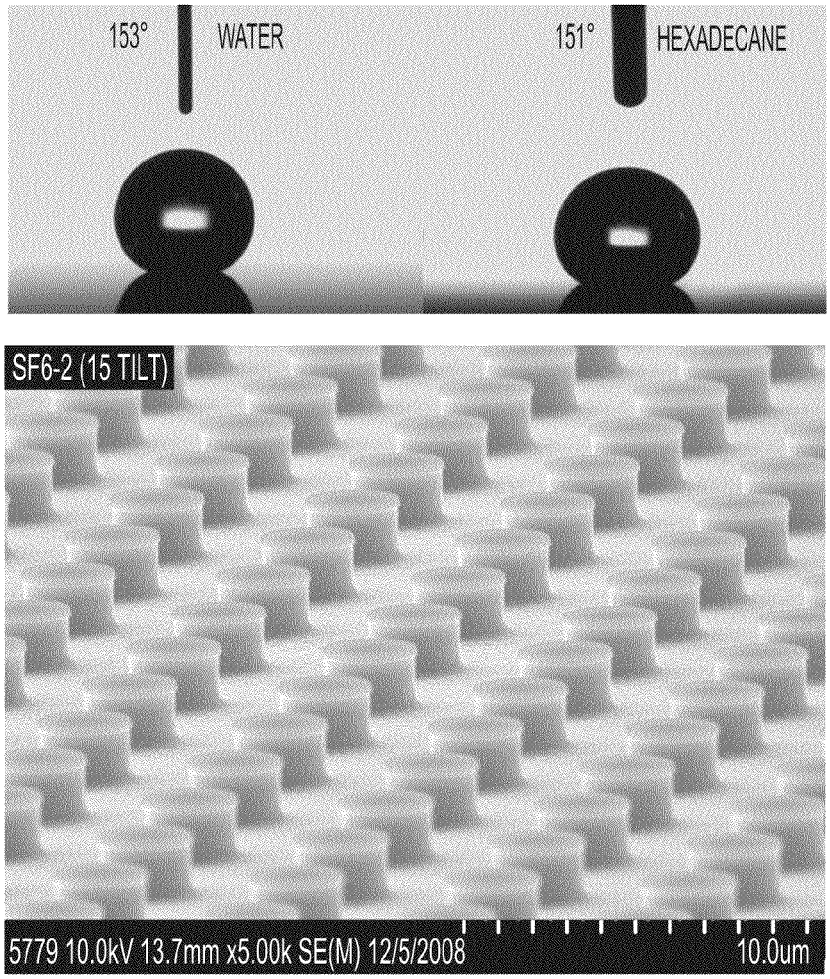
FIG. 7 is a micrograph of a fluorosilane-coated textured silicon surface comprising an array of pillar structures having an overhang re-entrant structure formed from a second material (silicon oxide) and showing static contact angles for water and hexadecane with the silicon surface.
Figure 8:
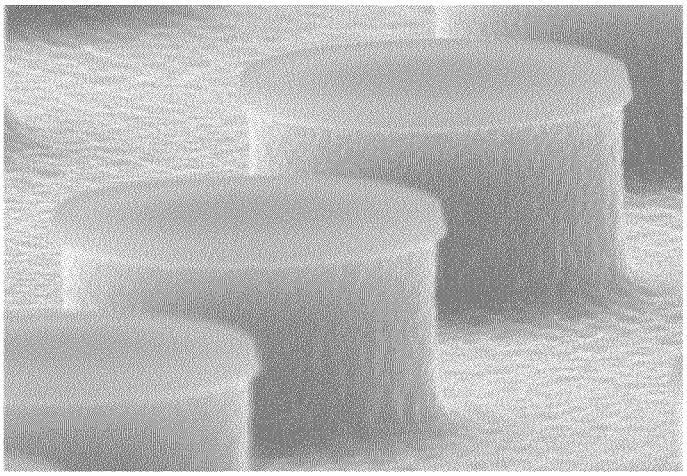
FIG. 8 is an enlarged view of a portion of the overhang re-entrant structure of FIG. 7.

FIG. 7 provides a micrograph of a fluorosilane-coated textured silicon surface comprising an array of pillars having overhang re-entrant structures wherein the overhang re-entrant structures are formed from a second material (silicon dioxide) defined on the top of the pillars and a set of photographs showing static contact angles for water and hexadecane octane on the fluorosilane-coated textured silicon surfaces. The contact angles for the FOTS coated textured silicon surface with water and hexadecane are 153° and 151°, respectively. FIG. 8 provides an enlarged view of a portion of the surface of FIG. 7 showing details of the overhang re-entrant feature.

The pillar array can have any suitable spacing or pillar density or solid area coverage. In embodiments, the array of pillars has a solid area coverage of from about 0.5% to about 40%, or from about 1% to about 20%. The pillar array can have any suitable spacing or pillar density. In a specific embodiment, the array of pillars has a pillar center-to-pillar center spacing of about 6 micrometers.

The pillar array can have any suitable shape. In embodiments, the array of pillars can be round, elliptical, square, rectangular, triangle, star-shaped or the like.

The pillar array can have any suitable diameter or equivalent diameter. In embodiments, the array of pillars can have diameter of from about 0.1 to about 10 micrometers, or from about 1 to about 5 micrometers.

The pillars can be defined at any suitable or desired height. In embodiments, the textured silicon can comprise an array of pillars having a pillar height of from about 0.3 to about 10 micrometers, or from about 0.5 to about 5 micrometers.

Figure 9:
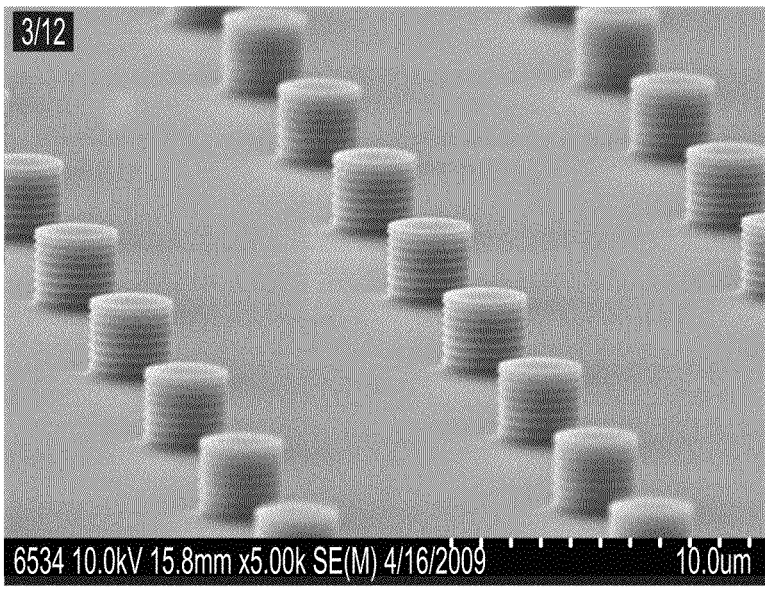
FIG. 9 is a micrograph of an array of pillar structures having a 3 micrometer pillar height.
Figure 10:
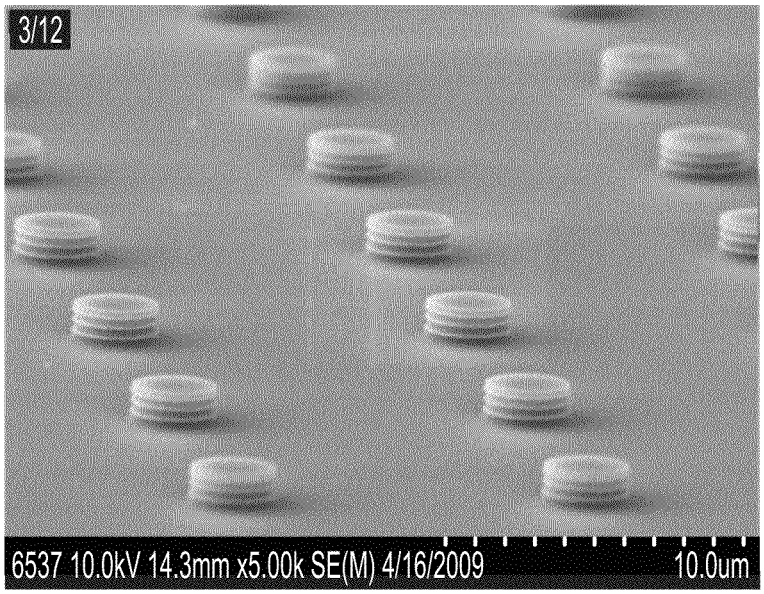
FIG. 10 is a micrograph of an array of pillar structures having a 1.1 micrometer pillar height.

In FIG. 9, a micrograph shows a superoleophobic textured silicon surface comprising an array of pillars having a 3.0 micrometer pillar height. In FIG. 10, a micrograph shows a superoleophobic textured silicon surface comprising an array of pillars having a 1.1 micrometer pillar height.

Figure 11:
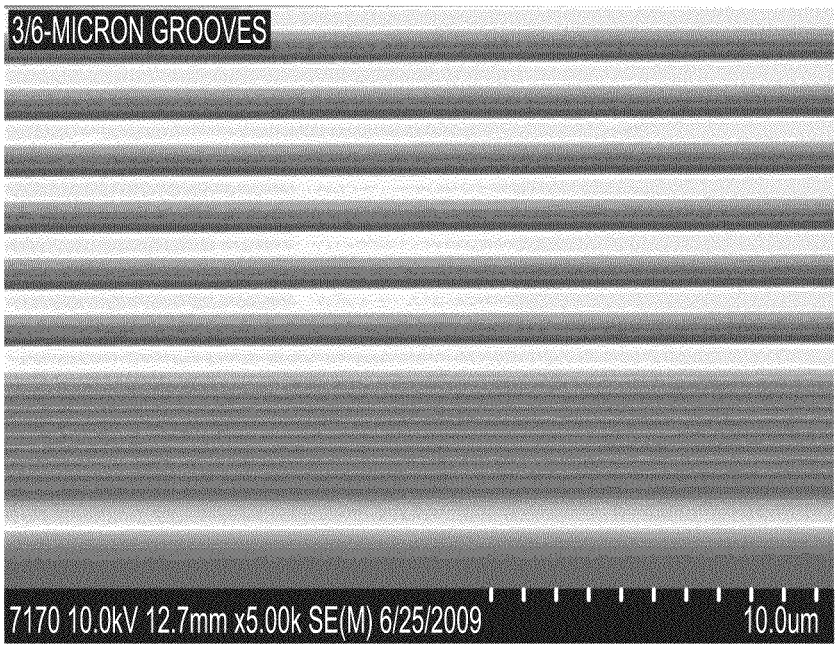
FIG. 11 is a micrograph of a fluorosilane-coated textured surface comprising groove structures having textured (wavy) sidewalls.
Figure 12:
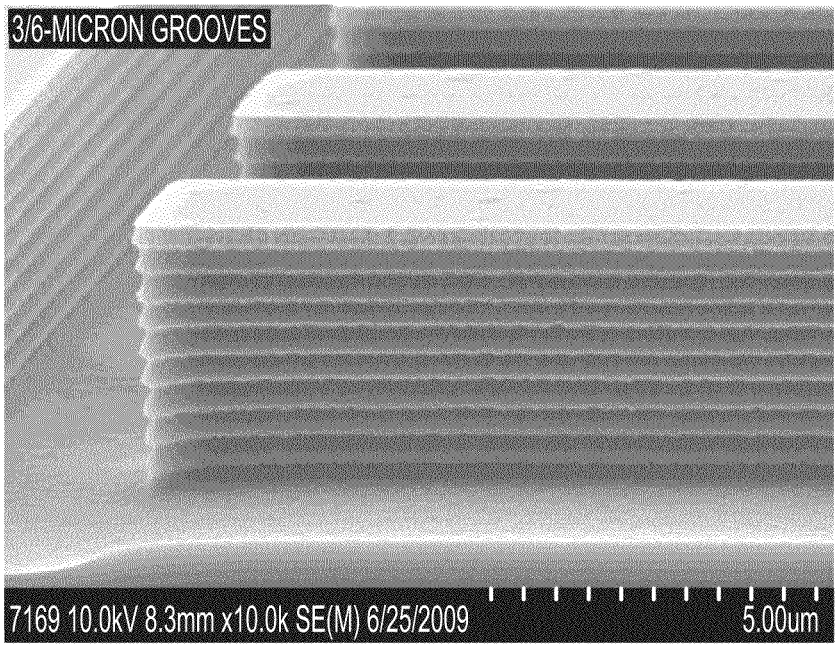
FIG. 12 is an alternate view of the surface of FIG. 11.

In another embodiment, the superoleophobic textured silicon surfaces herein comprise a groove structure. FIG. 11 provides a micrograph of a structure in accordance with the present disclosure comprising fluorosilane-coated silicon grooves 3 micrometers in width and 6 micrometers in pitch. FIG. 12 provides an alternate view of the structure of FIG. 11, showing the groove wavy sidewall structure with the topmost surface of the groove structure forming an overhang re-entrant structure.

The groove structure can have any suitable spacing or pillar density or solid area coverage. In embodiments, the groove structure has a solid area coverage of from about 0.5% to about 40%, or from about 1% to about 20%.

The groove structure can have any suitable width and pitch. In a specific embodiment, the grove structure has a width of from about 0.5 to about 10 micrometers, or from about 1 to about 5 micrometers, or about 3 micrometers. Further, in embodiments, the groove structure has a groove pitch of from about 2 to about 15 micrometers, or from about 3 to about 12 micrometers, or about 6 micrometers.

The textured patterned structures herein, in embodiments, pillar or groove structures, can have any suitable shape. In embodiments, the overall textured structure can have or form a configuration designed to form a specific pattern. For example, in embodiments, the pillar or groove structure can be formed to have a configuration selected to direct a flow of liquid in a selected flow pattern.

The groove structure can be defined at any suitable or desired total height. In embodiments, the textured surface can comprise groove pattern having a total height of from about 0.3 to about 10 micrometers, or from about 0.3 to about 5 micrometers, or from about 0.5 to about 5 micrometers.

While not wishing to be bound by theory, the inventors believe that the high contact angles observed for the FOTS textured surface with water and hexadecane is the result of the combination of surface texturing and fluorination. In specific embodiments, the textured devices herein comprise at least one of a wavy sidewall feature or an overhang re-entrant structure at the top surface of the groove or pillar structure to provide flexible superoleophobic devices. While not wishing to be bound by theory, the inventors believe that the re-entrant structure on the top of the groove or pillar is a significant driver for superoleophobicity.

Table 1 summarizes the contact angle data for a number of relevant surfaces with water, hexadecane, solid ink and ultraviolet curable gel ink. Sample 1 comprises a printhead as described in U.S. Pat. No. 5,867,189, which is hereby incorporated by reference herein in its entirety. Sample 2 is a smooth polytetrafluoroethylene surface. Sample 3 is a superoleophobic surface prepared in accordance with the present disclosure having a textured surface comprising an array of 3 micrometer in diameter, 7 micrometer in height pillars with a center-to-center spacing of about 6 micrometers, and wavy sidewalls. Sample 4 is a groove structure comprising wavy sidewalled grooves wherein droplets slide parallel to the groove direction. For the textured surfaces herein, both water and hexadecane achieved contact angle of about 158°, with a sliding angle of about 10° on the wavy sidewall posts, illustrating the surface character of superhydrophobicity and superoleophobicity—super repelling water and oil. This textured surface also demonstrated superior anti-wetting properties towards solid ink with a contact angle of about 155°, as shown in Table 1. For the groove structure surfaces herein, sliding angles are even lower than the pillar structure surfaces, with hexadecane having a sliding angle of 4° and solid ink having a sliding angle 25°. The polytetrafluoroethylene (PTFE) materials are hydrophobic and oleophilic with very high sliding angles for both water and hexadecane, corresponding to strong adhesion on the interface. Solid ink has contact angle of lower than 90°, showing its intrinsic philic property and it didn't move even when tilted to 90° or upside down. The data is summarized in Table 1.

TABLE 1

| | Water | | Hexadecane | | Solid Ink (~105° C.) | | UV ink (~75° C.) | |
|---|---|---|---|---|---|---|---|---|
| Example | Contact Angle | Sliding Angle | Contact Angle | Sliding Angle | Contact Angle | Sliding Angle | Contact Angle | Sliding Angle |
| 1 | ~130° | >90° | ~71° | ~64° | — | — | — | — |
| 2 | ~118° | ~64° | ~48° | ~31° | ~63° | >90° | ~58° | >90° |
| 3 | ~156° | ~10° | ~158° | ~10° | ~155° | 33°-58° | ~146° | ~10° |
| 4 | ~131 | ~7.5 | ~113 | ~4 | ~120 | ~25 | — | — |

Figure 13:
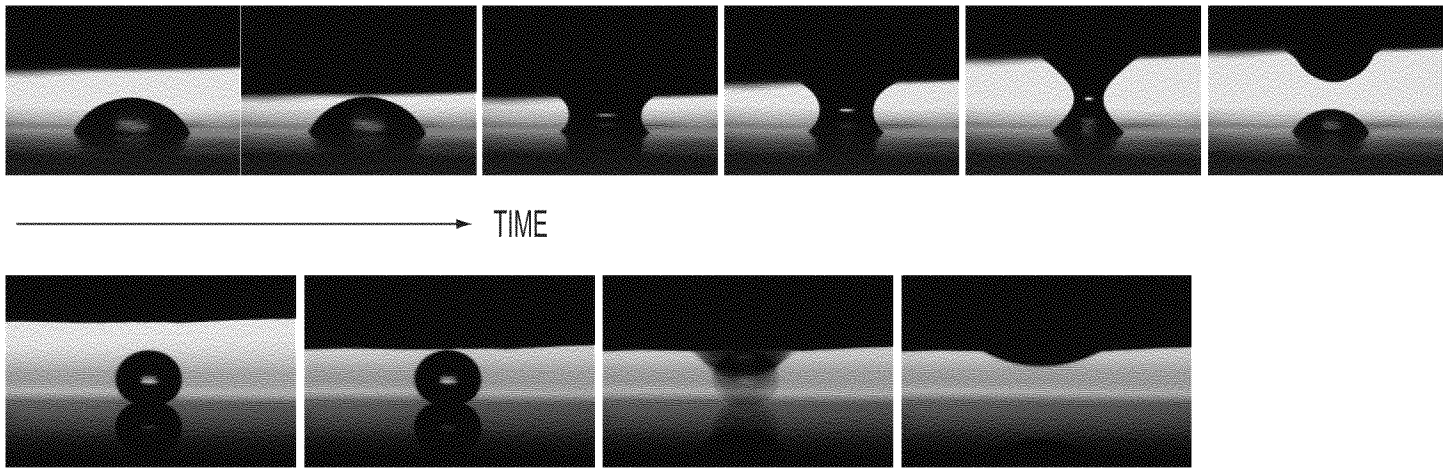
FIG. 13 is a simulated illustration of a molten slid ink droplet interaction with Xerox® 4200® multipurpose paper and a smooth polytetrafluoroethylene surface (top) and a textured oleophobic surface in accordance with the present disclosure (bottom).

FIG. 13 shows 1 comparison of ink offset between a smooth PTFE (Teflon®) surface and a textured superoleophobic surface in accordance with the present disclosure. To illustrate the distinct wetting performance of the materials, a solid ink droplet of Xerox Color Qube™ cyan solid ink available from Xerox Corporation was picked up by Xerox® 4200® paper from the present superoleophobic surface having a wavy sidewall (top row) and a PTFE surface (bottom row). The solid ink drop sticks on both paper and PTFE, which eventually leads it to split in two pieces showing "offset" on PTFE surface. Behaving very differently, the solid ink droplet just leaves the present superoleophobic surface and completely transfers onto the paper.

In embodiments, the textured oleophobic silicon ink jet print head nozzle plates are mechanically robust. The pillar height effect on the superhydrophobicity and superoleophobicity was determined by controlling the etching time. A pattern of 3 micrometer in size (diameter), 12 micrometers in pitch (pitch meaning the pillar center-to-center distance), and having different heights of 7 micrometers, 3 micrometers, 1.5 micrometers, 1.1 micrometers, and 0.8 micrometer were selected. The pillars of 3 micrometers were shown in FIG. 9 and the pillars of 1.1 micrometers height were shown in FIG. 10. It was determined that even for a pillar height of 1.1 micrometers (3 wavy periods), both superhydrophobicity and superoleophobicity were demonstrated by consistent high contact angles and low sliding angles comparing with their counterpart pillars of different heights of up to 7 micrometers. When pillar height decreases to about 0.8 micrometer (2 wavy periods), superhydrophobicity and superoleophobicity cannot be maintained. It can be concluded that for both water and hexadecane, only the first couple of waves on the sidewall are wetted and extremely high pillar height is not required to achieve superhydrophobicity and superoleophobicity. In this way, the present textured silicon material with low pillar height significantly improves the mechanical robustness of those pillars (lower aspect ratio). In embodiments herein such as silicon nozzle plates, there is no external pressure applied that can force the ink down the side of the pillar and the pillar height can be reduced to below 5 micrometers, further enhancing the mechanical robustness of the silicon nozzle plate surface.

In specific embodiments, the print head silicon nozzle plate herein comprises a silicon nozzle plate comprising deep reactive ion-etched (DRIE) nozzles. The nozzle plate consists of a silicon-on-insulator wafer that is ground and polished to the desired thickness, such as, but not limited to, about 20 to about 30 micrometers, although any thickness that renders the material planar enough to be suitable for further photolithography and processing is suitable. The remainder of the process comprises patterning and etching of surface modification features, and patterning and etching of the nozzles. The problem is that the nozzles can't be done first because they would prevent further photolithography (the deep holes would interfere with the spinning of photoresist), but the surface modification can't be done first because the photoresist won't stick to the resulting hydrophobic surface.

Returning to FIG. 1, in specific embodiments, the present process comprises performing both of the patterning steps, surface modification and nozzle formation, at the beginning of the process, for example by using masking layers to temporarily "store" the pattern information, and then performing the etching. The left branch of FIG. 1 leads to standard pillars or posts or grooves having wavy sidewalls, depending on the details of the etch. The right branch of FIG. 1 results in pillars having overhang re-entrant structures, or "T-topped" posts/pillars/grooves with caps. In embodiments, 12 indicates silicon, 14 indicates a material that can be selectively etched without attacking silicon (i.e.: silicon dioxide), and 16 indicates a different material that can be etched without attacking the other two layers (such as silicon nitride). As describe more thoroughly above, to create the overhang re-entrant structures, an isotropic silicon etch is added which undercuts the etch mask. The etch mask is then left in place. In embodiments, at the end of both of the branches, an anti-wetting coating can be disposed on the textured surface (not shown).

The left branch of the process shown in FIG. 1 is mostly subtractive, meaning that the structures are defined by etching away material. However, the process herein can also include additive processes. For example, the nozzle plate can be coated with oxide such as silicon oxide, nitride such as silicon nitride, a polymer, or a metal layer, SU-8 or KMPR® photoresist, which can then be patterned to create posts or ridges. To create overhang re-entrant structures, multiple materials can be used, with the materials selectively etched to create the overhang re-entrant profile. For example, a metal layer can be deposited on top of an oxide layer. The metal can be patterned, followed by a wet or vapor HF etch of the oxide, undercutting the metal to create the overhang re-entrant profile.

In further embodiments, an unbroken solid (not etched) ring can be disposed around the nozzle in order to avoid having ink from the nozzle travel laterally and get under the pillars. With this configuration, when ink spills over the surface it is forced to come at the patterned geometry from the top, not the side (where it would degenerate into the Wenzel state). In the subtractive (etched) fabrication process, the ring can be etched right in the silicon, so it isn't "attached" per say. In this case, the nozzle and the ring are both carved out of the same silicon layer. Or, alternately, the silicon ring can also have a wide top of silicon dioxide, or metal, or some other dissimilar material to create a reentrant structure.

Alternatively, in the additive case (layers are deposited), the ring can be made of deposited silicon, oxide, polymer, metal, etc. In this embodiment, the layers can be deposited on top of the silicon, so no adhesive is required (with care taken to assure the ring material adheres properly).

The present inventors have demonstrated that superoleophobic surfaces (for example, wherein hexadecane droplets form a contact angle of greater than about 150° and a sliding angle of less than about 10° with the surface) can be fabricated by simple photolithography and surface modification techniques on a silicon wafer. The prepared superoleophobic silicon surface is very "ink phobic" and has the surface properties very desirable for the front face or nozzle plates of inkjet printheads, for example, high contact angle with ink for super de-wetting and high holding pressure and low sliding angle for self clean and easy clean. Generally, the greater the ink contact angle the better (higher) the holding pressure. Holding pressure measures the ability of the aperture plate to avoid ink weeping out of the nozzle opening when the pressure of the ink tank (reservoir) increases.

The superoleophobic surfaces described herein can be particularly suitable for use as front face materials for ink jet printheads. In embodiments, an ink jet printhead herein comprises a nozzle plate comprising silicon, wherein the silicon comprises a textured pattern; and an optional fluorosilane coating disposed on the textured silicon surface. In further embodiments, an ink jet print head herein comprises a front face or nozzle plate comprising silicon, wherein the silicon comprises a textured pattern; and an optional fluorosilane coating disposed on the textured silicon surface.

In embodiments, the present ink jet print heads are self-cleaning such that a wiper blade or other contact cleaning mechanisms is not required. Alternately, the present ink jet print heads enable use of a non-contact cleaning system, such as an air knife system, thereby eliminating the need for potting of full-width array heads, allowing defective subunits to be more easily replaced after jet testing.

The present ink jet print head front face or nozzle plates comprise textured silicon surfaces, such as patterns of shallow (for example, less than about 5 micrometer) grooves, pillars (or posts), or pillars posts with oversized caps/overhang re-entrant structures on the nozzle front face. This textured nozzle front face is technically oleophobic which increases the contact angle of the ink significantly together with low sliding angles. The textured silicon nozzle front face can be prepared at low cost, and can be used in combination with front face coatings. The present process and nozzle plates prepared therewith provide a number of advantages including, but not limited to: a) an improved containment of the meniscus, making jetting more reproducible and reducing flooding; b) when flooding does occur or ink gets on the front face for any other reason, it tends to roll right off, resulting in fewer missing or misdirected jets; c) improved image quality; d) reduced frequency of front-face maintenance thereby reducing down time and wasted supplies, and minimizing wear on any front face coating disposed over the textured front face; e) when mechanical wiping is used, the grooves (and pillars) act as protection for the front-face coating, since the coating can only wear on the top, not on the sidewalls or floor; f) during wirebond encapsulation, the hydrophobic/oleophobic front face helps prevent encapsulant from spilling onto the nozzle plate and getting into the nozzles; g) allows for certain portions of the nozzle plate to repel ink while other areas attract it, which enables ink to be directed away from the nozzles.

In embodiments, the present enhanced ink-phobicity of the front face or nozzle plate surface, renders the wiper blade cleaning system unnecessary. Therefore, the wiper blade can be replaced with a non-contact cleaning system, which has several advantages. First, a non-contact cleaning system eliminates blade-induced wear on the surface, and allows for more flexibility in choice of coating. Second, full-width array heads typically require the cracks between subunits to be filled in (potted) to prevent sharp die edges from damaging the rubber blade, but this potting makes it difficult to remove defective or failed subunits. The potting would have to be removed, which is difficult, and it would have to be replaced without clogging or damaging the new or existing subunits. The present non-contact maintenance scheme reduces or eliminates altogether the need for potting.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A process for preparing an ink jet print head front face or nozzle plate having a textured superoleophobic surface comprising:

providing a silicon substrate;

using photolithography to create a textured pattern in the silicon substrate;

wherein the textured pattern comprises a groove pattern having a total height of about 0.5 to about 5 micrometers; or wherein the textured pattern comprises an array of pillars having a pillar height of about 0.5 to about 5 micrometers; and modifying the textured silicon surface by disposing a conformal oleophobic coating thereon; and forming an ink jet print head front face or nozzle plate from the textured oleophobic silicon material to provide an ink jet print head front face or nozzle plate having a textured superoleophobic surface.

2. The process of claim 1, wherein modifying the textured silicon substrate comprises chemical modification by self-assembling a fluorosilane coating onto the textured silicon surface conformally via a molecular vapor deposition technique, a chemical vapor deposition technique, or a solution self assembly technique.

3. The process of claim 1, wherein the textured pattern comprises an array of pillars having an overhang re-entrant structure disposed on said pillars, an array of pillars having textured, wavy sidewalls, or a combination thereof.

4. The process of claim 1, wherein the textured pattern comprises a groove pattern including an overhang re-entrant structure, a groove pattern including textured, wavy sidewalls, or a combination thereof.

5. The process of claim 1, wherein the textured pattern has a configuration that directs a flow of liquid in a desired flow pattern.

6. The process of claim 1, wherein the textured pattern comprises an array of pillars and wherein the pillars are round, elliptical, square, rectangular, triangle, or star-shaped.

7. An ink jet print head front face or nozzle plate having a textured superoleophobic surface comprising:

a silicon substrate having a textured pattern;

wherein the textured pattern comprises a groove pattern having a total height of about 0.5 to about 5 micrometers; or wherein the textured pattern comprises an array of pillars having a pillar height of about 0.5 to about 5 micrometers; and a conformal oleophobic coating disposed on the textured silicon surface.

8. The ink jet print head front face or nozzle plate of claim 7, wherein the textured pattern comprises an array of pillars having an overhang re-entrant structure disposed on said pillars, an array of pillars having textured, wavy sidewalls, or a combination thereof.

9. The ink jet print head front face or nozzle plate of claim 7, wherein the textured pattern comprises a groove pattern including an overhang re-entrant structure, a groove pattern including textured, wavy sidewalls, or a combination thereof.

10. The ink jet print head front face or nozzle plate of claim 7, wherein the front face or nozzle plate is self cleaning.

11. An ink jet printhead comprising:

a textured oleophobic ink jet print head front face or nozzle plate comprising a silicon substrate comprising a textured pattern; and a conformal oleophobic coating disposed on the textured silicon surface;

wherein the textured pattern comprises a groove pattern having a total height of about 0.5 to about 5 micrometers; or wherein the textured pattern comprises an array of pillars having a pillar height of about 0.5 to about 5 micrometers.

12. The ink jet print head of claim 11, wherein the textured pattern comprises an array of pillars having an overhang re-entrant structure disposed on said pillars, an array of pillars having textured, wavy sidewalls, or a combination thereof.

13. The ink jet print head of claim 11, wherein the textured pattern comprises a groove pattern including an overhang re-entrant structure, a groove pattern including textured, wavy sidewalls, or a combination thereof.

14. An ink jet print head front face or nozzle plate having a textured superoleophobic surface comprising:

a silicon substrate having a textured pattern; and a conformal oleophobic coating disposed on the textured silicon surface;

wherein the textured pattern comprises a groove pattern comprising a total height of about 0.5 to about 5 micrometers.

15. An ink jet print head front face or nozzle plate having a textured superoleophobic surface comprising:

a silicon substrate having a textured pattern; and a conformal oleophobic coating disposed on the textured silicon surface;

wherein the textured pattern comprises an array of pillars having a pillar height of about 0.5 to about 5 micrometers.

* * * * *